US007068804B2

(12) United States Patent
Batting

(10) Patent No.: US 7,068,804 B2
(45) Date of Patent: Jun. 27, 2006

(54) COMMUNICATION SYSTEM WITH COMMUNICATION ELEMENT ATTACHABLE TO PIVOTING BATTERY COMPARTMENT

(75) Inventor: Jes Anker Batting, Hellerup (DK)

(73) Assignee: Oticon A/S, Smorum (DK)

( * ) Notice: Subject to any disclaimer, the term of this patent is extended or adjusted under 35 U.S.C. 154(b) by 252 days.

(21) Appl. No.: 10/450,685

(22) PCT Filed: Dec. 19, 2001

(86) PCT No.: PCT/DK01/00842

§ 371 (c)(1),
(2), (4) Date: Oct. 22, 2003

(87) PCT Pub. No.: WO02/51203

PCT Pub. Date: Jun. 27, 2002

(65) Prior Publication Data

US 2004/0062409 A1 Apr. 1, 2004

(30) Foreign Application Priority Data

Dec. 19, 2000 (DK) ..... 2000 01905

(51) Int. Cl.
*H04R 25/00* (2006.01)

(52) U.S. Cl. ..... 381/330; 381/323; 381/324

(58) Field of Classification Search ..... 381/314–315, 381/322–324, 327, 330, 381
See application file for complete search history.

(56) References Cited

U.S. PATENT DOCUMENTS

| | | | | | |
|---|---|---|---|---|---|
| 3,475,566 | A | * | 10/1969 | Bauer | 381/323 |
| 3,493,695 | A | * | 2/1970 | Stork | 381/330 |
| 3,701,862 | A | * | 10/1972 | Vignini | 429/97 |
| 4,941,180 | A | | 7/1990 | Buettner | |
| 4,961,230 | A | * | 10/1990 | Rising | 381/323 |
| 6,144,748 | A | * | 11/2000 | Kerns | 381/312 |
| 2005/0123157 | A1 | * | 6/2005 | Kragelund et al. | 381/312 |

FOREIGN PATENT DOCUMENTS

| | | | |
|---|---|---|---|
| CH | 641619 | | 2/1984 |
| CH | 673743 | | 3/1990 |
| DE | 19601231 | | 7/1997 |
| DK | PA 2001 01823 | * | 1/2003 |
| WO | 0021336 A2 | | 4/2000 |
| WO | WO 03/049495 A1 | * | 6/2003 |

* cited by examiner

*Primary Examiner*—Sinh Tran
*Assistant Examiner*—Phylesha L Dabney
(74) *Attorney, Agent, or Firm*—Dykema Gossett PLLC

(57) ABSTRACT

The invention relates to a communication system comprising a housing adapted for placement behind an ear, the housing comprising a battery compartment which is pivotally mounted on the housing, and which has a recess. The communication system further comprises an communication element, which has a protruding element adapted for engagement with the recess in the battery compartment in such a manner that the communication element may be pivoted together with the battery compartment. Preferably the communication element when the battery compartment is in a closed position may not be displaced in relation to the communication device housing.

5 Claims, 8 Drawing Sheets

COMMUNICATION SYSTEM WITH COMMUNICATION ELEMENT ATTACHABLE TO PIVOTING BATTERY COMPARTMENT

AREA OF THE INVENTION

The invention relates to communication devices and more specifically to communication devices for placement over the ear of a user. Such devices include hearing aids and headsets and similar constructions which are intended for improving the listening situation for both normal hearing persons and hearing impaired. The invention especially is related to such devices which include a separate transmitter or receiver for communication with a further extended device,

BACKGROUND OF THE INVENTION

In connection with hearing aids it is well known to provide a so-called audio shoe in connection with the hearing aid housing, where this audio shoe itself comprises the communication electronics or where the communication electronics may be connected to the audio shoe.

These previously known solutions all several disadvantages, including risk of loss of communication electronics due poor engagement with the hearing aid or the audio shoe, and requirement of dismantling for change of battery.

One previously known construction is disclosed in CH 641619. This prior art document discloses two possible locations of an externally mounted receiver. One possible location is on the top of the housing. Although this location does not prevent the change of a battery, which is normally placed in the lower end of the housing, it is disadvantageous since the mass center of the hearing aid and the receiver is moved upwards and since in a hearing aid normally a very limited space is available in this area due to the presence of microphones and microphone inlets. Another possible location is at the bottom of the housing. This location is advantageous in respect of the location of the mass center, but is disadvantageous in respect of the possibility of battery change since the receiver will block the opening of the battery compartment.

Given this background, objective of the present invention is to provide a communication system which reduces the risk of loss and which will allow change of a battery without dismantling of the communication system. A further objective is to provide a communication electronics element for connection with a communication device, which reduces the risk of loss and which will allow change of a battery without dismantling of the communication electronics.

SUMMARY OF THE INVENTION

According to the invention the first objective is achieved by means of a communication device which includes a housing, a battery drawer pivotally connected to the housing, and a communication element which is attachable to the battery drawer to be pivotally movable with the battery drawer.

By means of such device the battery drawer may still be opened for change of the battery without dismantling the receiver. This is advantageous, especially for hearing aid users having limited ability to handle small mechanical parts. The presence of the receiver even can improve handling as the receiver may function as a handle for the opening of the battery drawer.

In a preferred embodiment the communication element is attached to the battery drawer such that it cannot be placed in relation to the hearing device housing when the battery drawer is pivoted to a closed positioned relative to the housing. Thus increased security against loss is achieved. When the battery drawer is closed, the receiver is blocked against release in two directions. This is a significant security against loss of the receiver without the use of tools and fastening elements. Furthermore, changing a battery is still possible without the need of removing the communication element from the hearing aid as it simply pivots together with the battery drawer.

In another preferred embodiment the communication element can be snap-locked to the housing.

In another preferred embodiment the communication element is connected to the battery drawer by a part thereof being inserted in a recess in the battery drawer in a direction generally parallel to the pivoting axis of the battery drawer, achieving an easy mounting of the communication element and reliable security against loss.

In another preferred embodiment a power switch is incorporated in the battery drawer and is activated by pivoting the battery drawer, the communication element may still not be displaced in relation to the hearing device housing in this position of the battery drawer, the security against loss is maintained in the situation where such apparatus is subject to an attempt of opening. This furthermore provides for an increased child safety of the communication element in the assembled state, as the communication element often is a tiny element that may be swallowed by children.

According to the invention the second objective is achieved by means of the communication electronics element which includes a nrotrudinq portion that can engage in a recess of a batterv drawer pivotally mounted on a housing of a communication system.

In a preferred embodiment of such a communication element, when the battery compartment is in a closed position it may not be displaced in relation to the hearing device housing and thus an increased security against loss of the communication element is achieved.

The invention will be explained more detailed in the following description of a preferred embodiment, with reference to the drawings.

DESCRIPTION OF A PREFERRED EMBODIMENT

Figure 1:
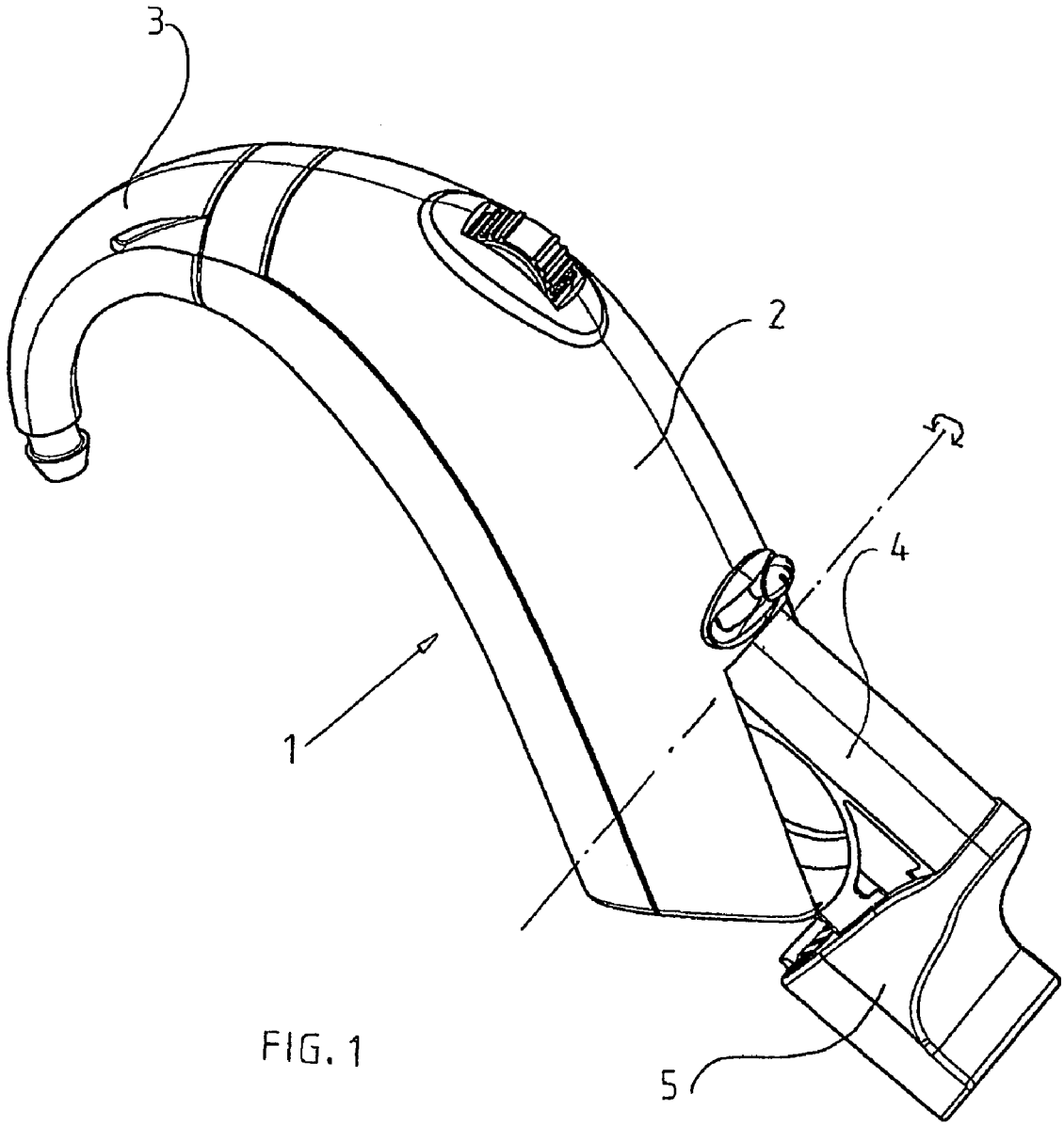
FIG. 1 is a view of a communication device with a pivotable battery compartment in a open position, where an communication element has been mounted on the battery compartment.

Referring to FIG. 1 a communication device in the form of a hearing aid 1 is shown. The hearing aid comprises a housing 2 and a so-called hook 3. In the housing several elements forming the sound processing part of the hearing aid are disposed. These parts, which are not shown, comprise a signal path having a microphone, a signal processor and a output transducer. In order to provide power to the operation of the signal path a battery is provided in a battery drawer 4. The battery drawer is hinged pivotally in the housing to allow opening for change of the battery. On the battery drawer a communication element 5 is provided. The actual communication element is a radio frequency receiver. A programming shoe for wired/wireless programming would be placed in a similar manner. It appears that the communication element is pivotally mounted together with the battery drawer to be pivoted about the same axis as the battery drawer.

Figure 2:
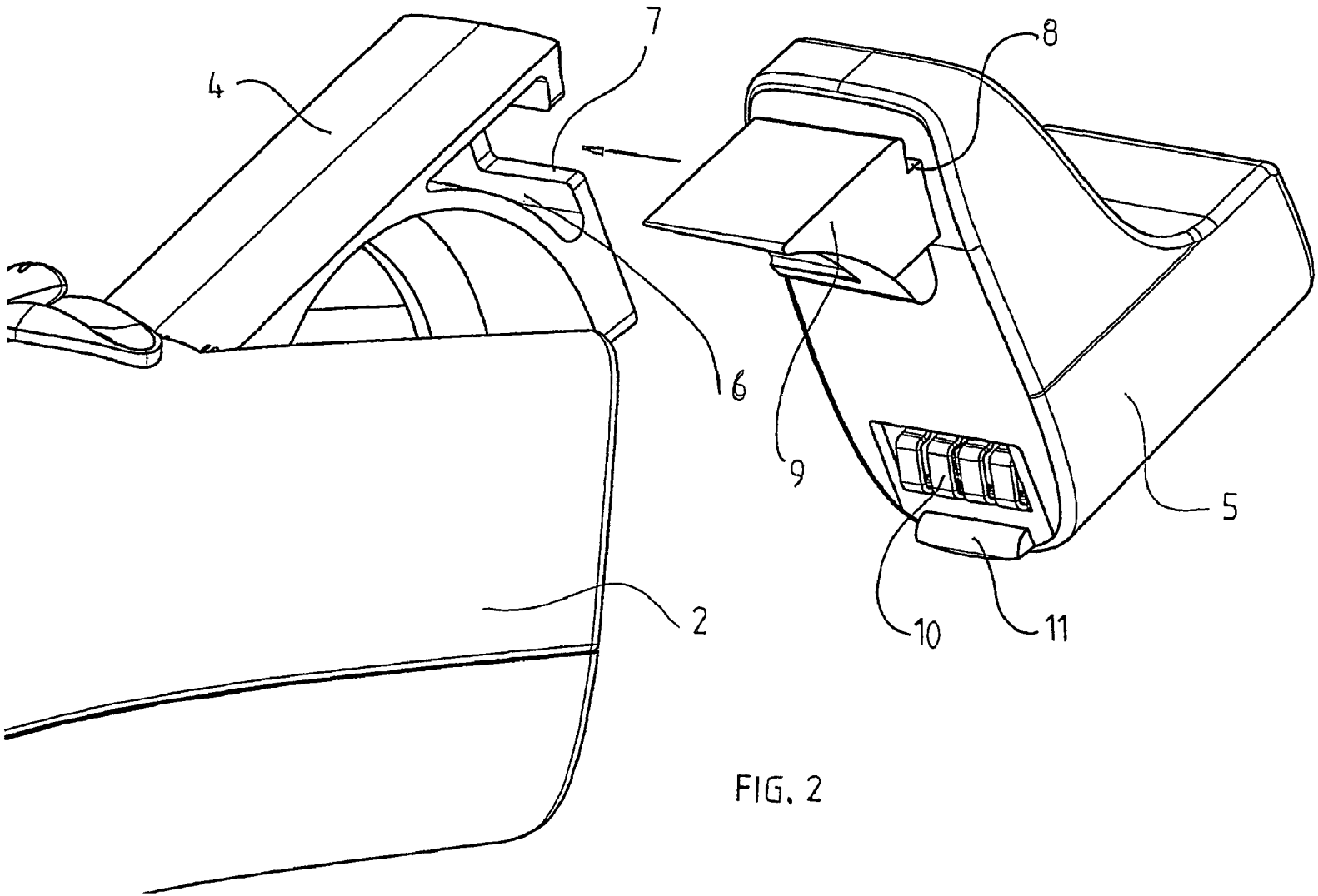
FIG. 2 is an enlarged partial view of a communication device and an communication element in a separated position.

From FIG. 2 the communication element appears in a position separated from the hearing aid. It appears further that the communication element is assembled with the battery drawer by inserting the communication element into a recess 6 in the battery drawer. In one of the wall parts surrounding the recess an incision 7 or cutout provides space for a outward extending part of the communication element and an insertion part 9 being formed complementary to the recess. Contact elements 10 appear on the communication element, which are adapted for establishing electrical contact to the power supplying battery and for delivering an output signal to the hearing aid signal path to allow the hearing impaired to listen to the received radio frequency signal. Corresponding contact elements (not shown) are located on the housing. Furthermore a part of a locking mechanism 11 is visible on the communication element.

Figure 3:
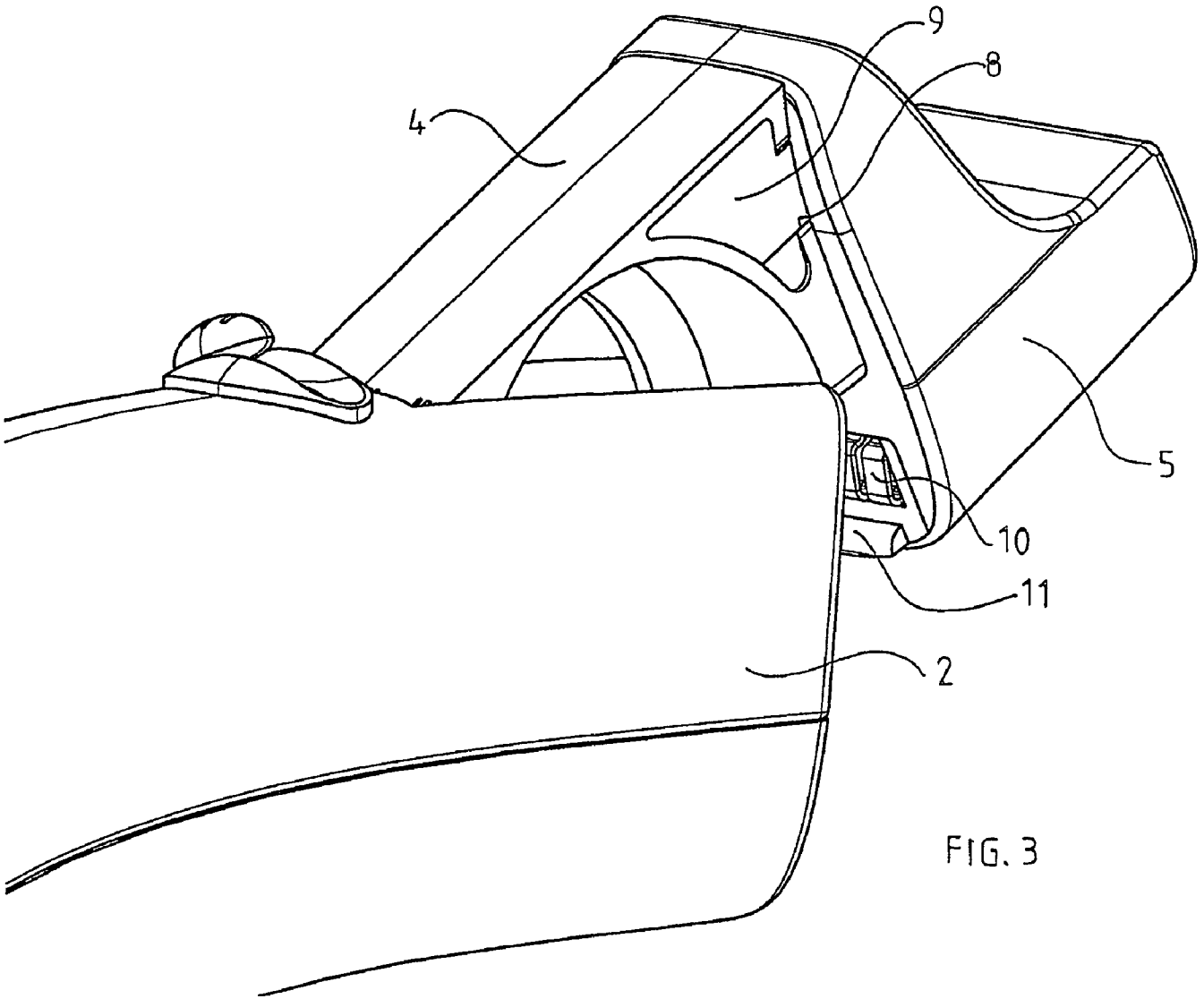
FIG. 3 is an enlarged partial view of a communication device and an communication element in an assembled position corresponding to FIG. 1.

Referring to FIG. 3 the communication element appears in a position mounted on the battery drawer. This corresponds to the view shown in FIG. 1.

Figure 4:
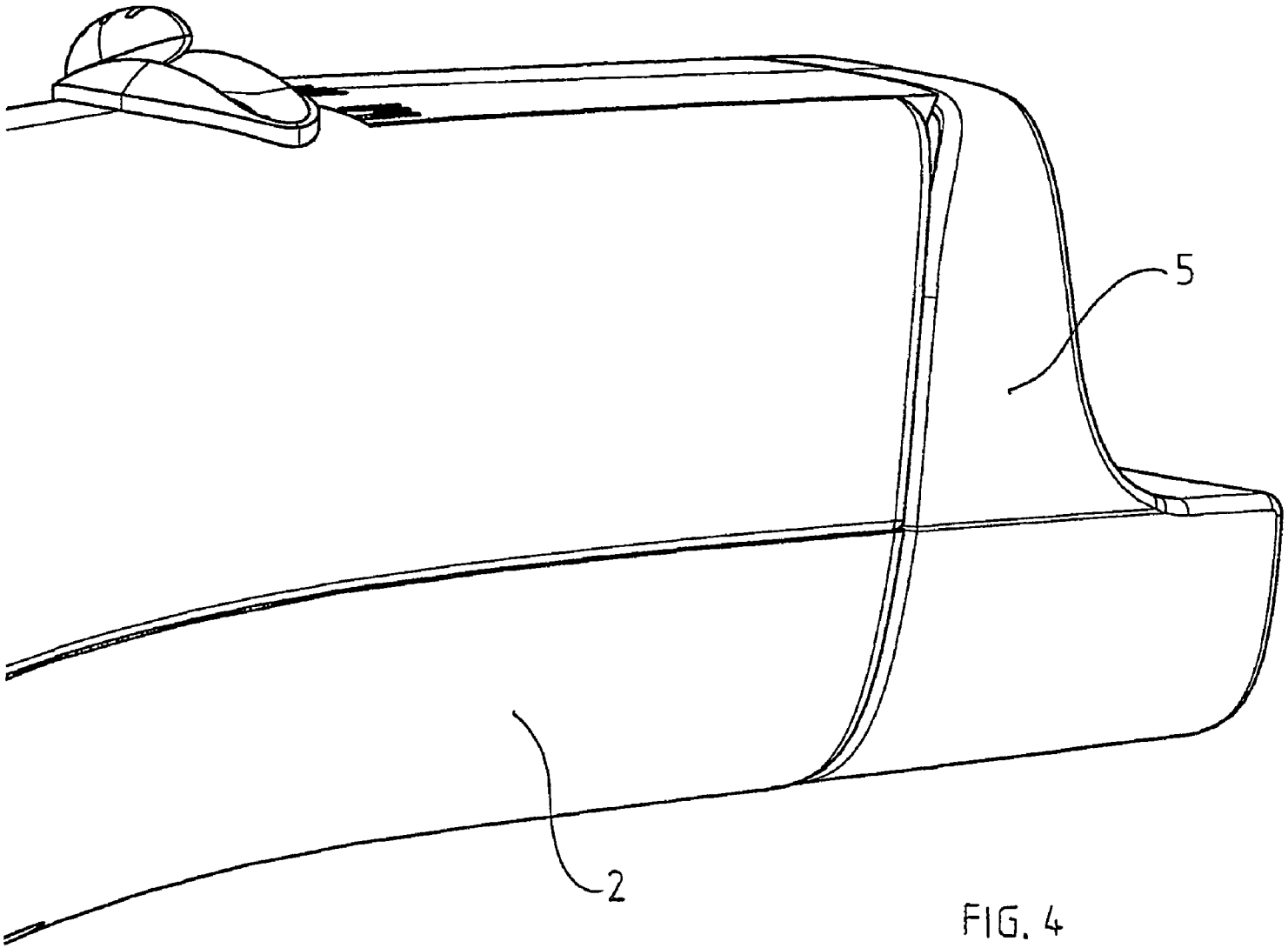
FIG. 4 is an enlarged partial view of a communication device and an communication element in an assembled position corresponding to FIG. 1 and with the battery compartment in a closed position.

Referring to FIG. 4 the battery drawer together with the communication element has been pivoted to a closed position, It appears that the construction allows the hearing aid housing and the communication element to be flush with each other, hereby enhancing the esthetics of the construction and furthermore reducing the size of the assembled construction leading to less irritation when placing the device behind the ear of a user. It is obvious that when attempting to displace the communication element to the side in relation to the housing. the movement will be blocked by the housing, hence proving an increased safety against loss.

Figure 5:
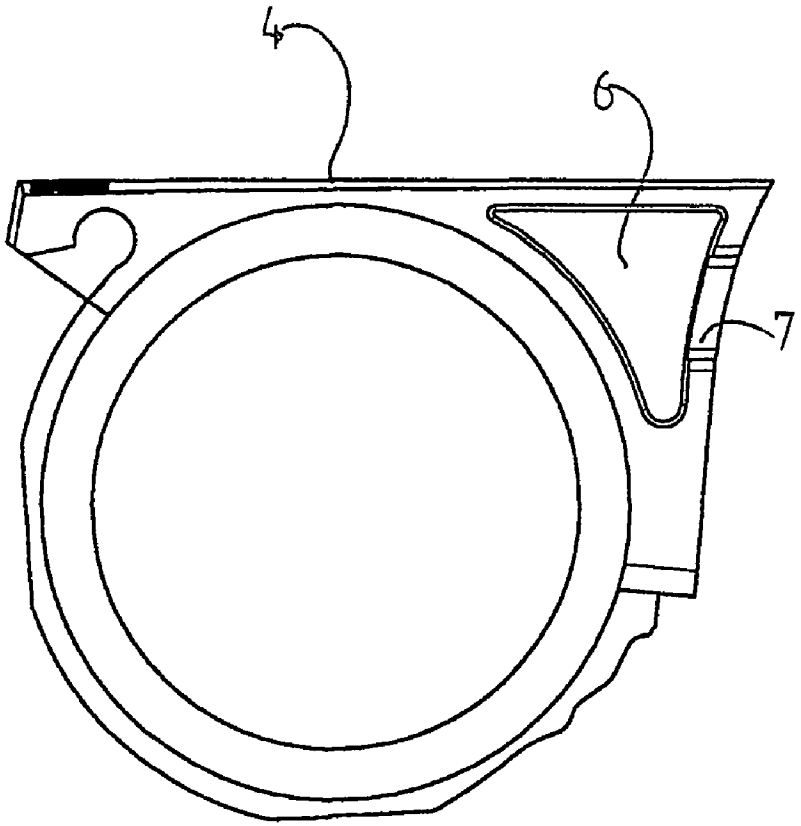
FIG. 5 is a side view of a battery drawer.
Figure 6:
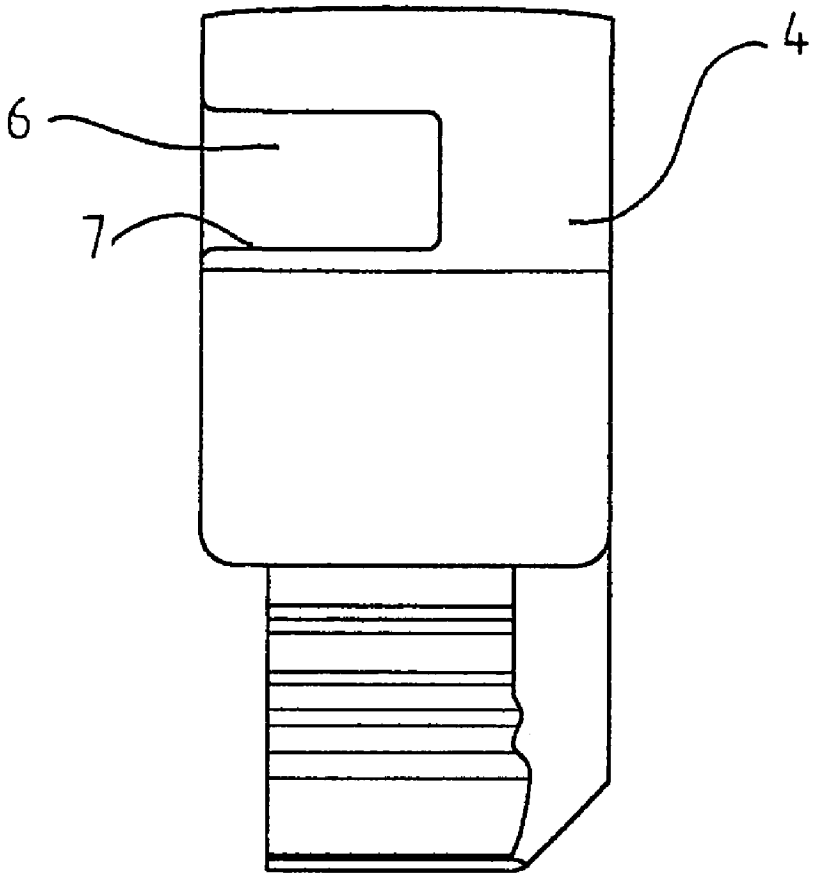
FIG. 6 is an end view of a battery drawer.

From FIG. 5 and FIG. 6 the battery drawer appears seen in a side view and an end view. The recess and the incision for accommodation of part of the communication element appear more detailed.

Figure 7:
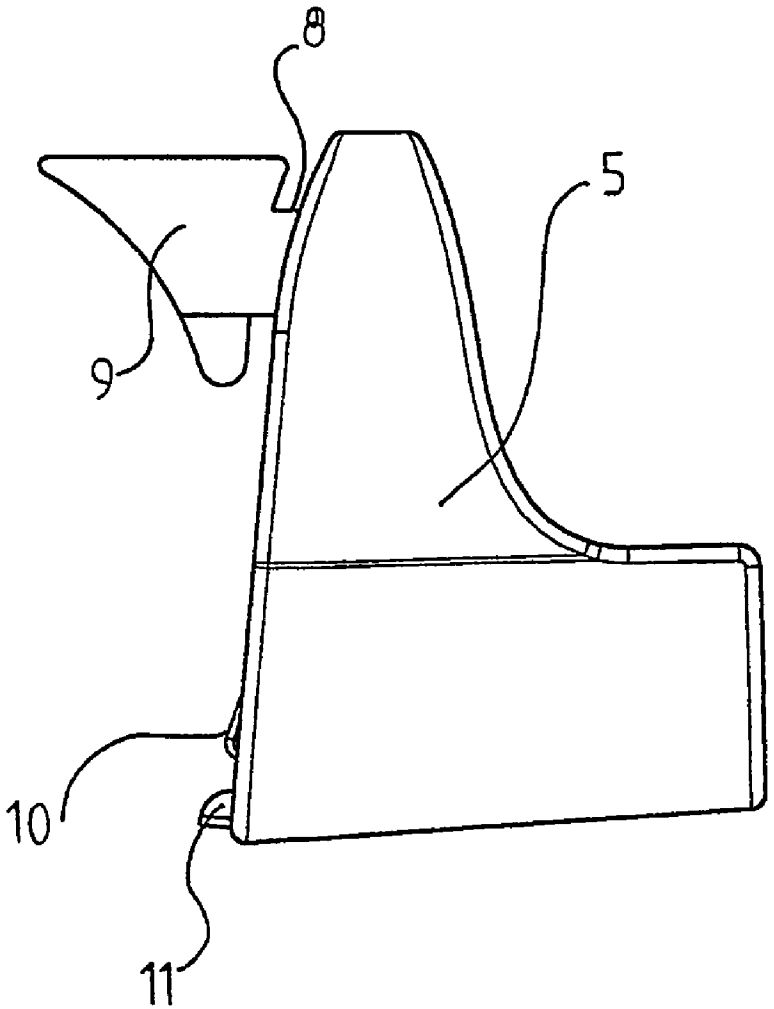
FIG. 7 is a side view of a communication element.
Figure 8:
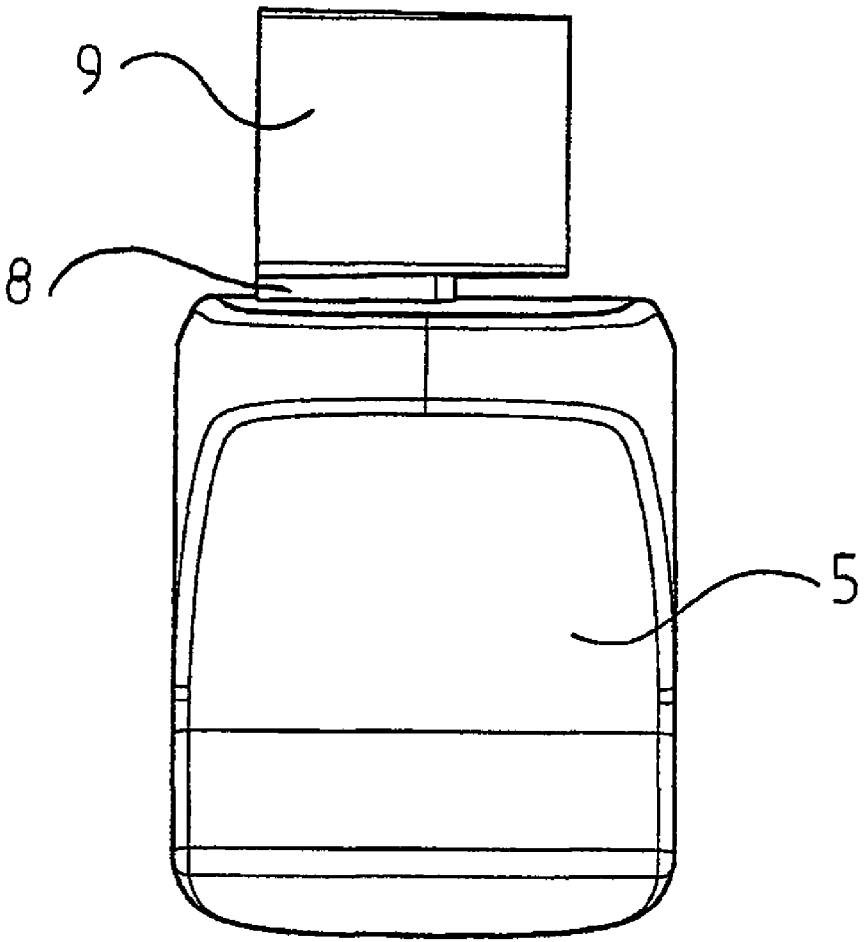
FIG. 8 is an end view of a communication element.

From FIG. 7 and FIG. 8 the communication element appears seen in a side view and an end view. The protruding part adapted for accommodation in the recess of the battery drawer appears with the connection part extending through the incision and the larger part having a cross section complementary to the cross section of the recess.

As an alternative the recess could be located in the communication element and the complimentary part could be located on the battery drawer, hereby simply inverting the location of the two mutually cooperating parts.

The invention claimed is:

1. A communication system comprising a housing adapted for placement behind an ear of a user, a battery drawer mounted on the housing to pivot about a pivot axis between an open and closed position, said battery drawer defining a recess; and a communication element which has a protruding element removably engaged in the recess in the battery drawer in such a manner that the communication element is pivoted together with the battery drawer about the pivot axis between the open and closed positions even when the battery drawer contains a battery.

2. A communication system according to claim 1, wherein the communication element is connected to the battery drawer such that when the battery drawer is in a closed position the communication element cannot be displaced in relation to the housing.

3. A communication system according to claim 1, wherein the protruding element of the communication element is inserted in the recess in a direction generally parallel to the pivot axis.

4. A communication system according to claim 1, including a safety lock which prevents pivoting of the battery drawer to the open position.

5. A communication system according to claim 1, wherein said housing is curved and the battery drawer is pivotally attached near a lower end thereof.

* * * * *